United States Patent [19]

Pala

[11] Patent Number: 4,846,726

[45] Date of Patent: Jul. 11, 1989

[54] ELECTRICAL CONTACT WITH OFFSET TAB

[75] Inventor: Ronald S. Pala, Mechanicsburg, Pa.

[73] Assignee: AMP Incorporated, Harrisburg, Pa.

[21] Appl. No.: 210,686

[22] Filed: Jun. 23, 1988

[51] Int. Cl.[4] ..... H01R 4/24

[52] U.S. Cl. ..... 439/492; 439/395

[58] Field of Search ..... 439/389–420, 439/492–499, 856, 861–862, 883

[56] References Cited

U.S. PATENT DOCUMENTS 3,325,770 12/1964 Hammell et al. .

3,474,394 10/1969 Hammell et al. .

4,193,201 3/1980 Van Horn ..... 439/395

4,288,141 9/1981 Leather ..... 439/395

4,402,564 9/1983 Frantz .

4,493,525 1/1985 Hall et al. .

*Primary Examiner*—Joseph H. McGlynn

*Attorney, Agent, or Firm*—Gerald K. Kita

[57] ABSTRACT

An electrical contact comprises; an elongated electrical contact portion, a wire connecting tab, an offset portion of the contact connecting the tab to a central portion of the contact, a first bend extending across a relatively wide section of the tab, a second bend extending across a relatively narrow section of the tab and parallel to the first bend, and a slot extending beside the tab, the first bend in the tab intersects the slot and the relatively wide section prevents concentration of stress from the first bend at the intersection of the tab and a bottom edge of the slot.

7 Claims, 2 Drawing Sheets

ELECTRICAL CONTACT WITH OFFSET TAB

FIELD OF THE INVENTION

The invention relates to an electrical contact of the type for mounting in an insulative housing and for connection to an electrical wire.

BACKGROUND OF THE INVENTION

An electrical contact known from U.S. patent application Ser. No. 181,360 comprises; an elongated electrical contact portion and a wire connecting tab offset from a longitudinal center axis of the contact portion. The tab is connected to a central portion of the contact by an offset bent portion of the contact for locating the tab in an offset plane.

An electrical connector assembly includes an insulative housing and two rows of spaced apart cavities in the housing. Metal electrical contacts, of the type described in the preceding paragraph of text, are mounted in corresponding cavities, such that the contacts are in two rows. The electrical contacts of the same first row have their corresponding tabs offset to lie in a common plane. The electrical contacts of the second row have their corresponding tabs offset to lie also in the same common plane.

Having the tabs available in a common plane facilitates a procedure of joining the tabs to corresponding wires. According to a known procedure, the wires are simultaneously overlaid upon the coplanar tabs and are connected in one joining operation, for example, by soldering or welding. Thus, to facilitate ease in connection of the tabs to corresponding wires, the tab of all the contacts are offset to lie in a common plane. Each tab is offset by forming two bends. The bends are relatively close to each other and are in the thickness of the tab. Because the tab is slender, stress of the material is distributed over a limited cross sectional dimension of the tab. Stress tends to be concentrated at the intersection of the tab with an edge surface. Concentration of stress occurring over a passage of time, or at the time the contact is driven into the cavity of the housing, may cause stress cracks to develop in the material.

SUMMARY OF THE INVENTION

An electrical contact of the type having an offset tab, further includes a tab having a first bend over a relatively wide section of the tab. The wide section distributes the stress. The contact further includes a slot that separates the tab from the edge surface. The slot has rounded corners that alleviate stress concentration. The first bend in the tab intersects the slot. The relatively wide section prevents concentration of stress from the first bend at an intersection of the tab and a bottom edge of the slot.

The invention will be described and shown, by way of example, according to a detailed description and accompanying drawings.

Figure 1:
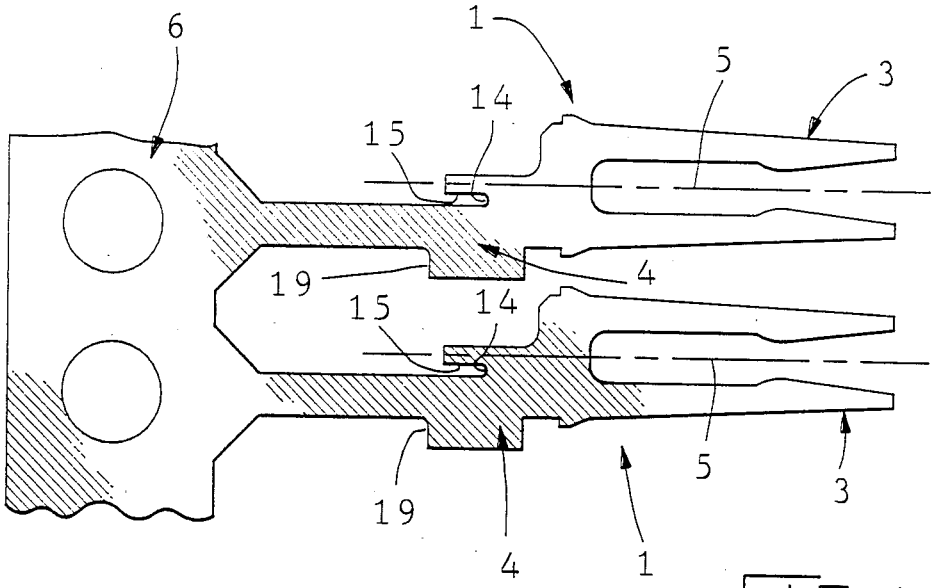
FIG. 1 is a plan view of an electrical contact projecting from a carrier strip.
Figure 2:
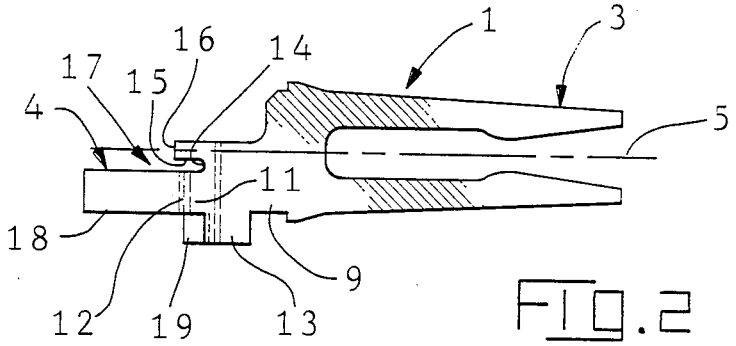
FIG. 2 is a plane view of the contact separated from the carrier strip.
Figure 3:
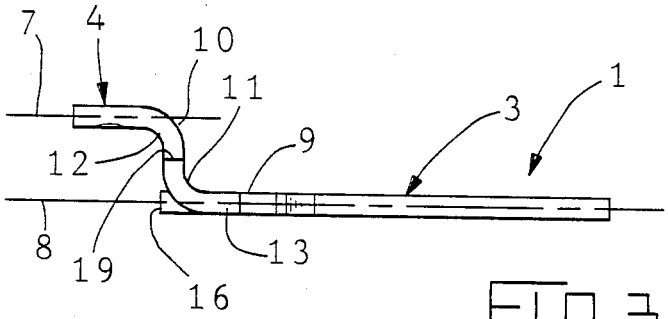
FIG. 3 is an elevation view of the contact.

With more particular reference to FIGS. 1, 2 and 3, the drawings, an electrical contact 1 is cut out from a strip 2 of metal and is formed with an elongated electrical contact portion 3 and an elongated, wire connecting tab 4 offset from a longitudinal center axis 5 of the contact portion 3. The tab 4 is connected to an elongated carrier strip 6 and is in a thickness plane 7 of the metal that is offset from the thickness plane 8 of a remainder of the contact 1. The tab 4 is connected to a central portion 9 of the contact 1 by an offset portion 10 of the contact 1 for locating the tab 4 in the offset plane 7.

In forming the offset portion 10, each tab 4 is offset by forming two bends 11, 12 that extend transversely of the axial length of the tab 4. The bends 11, 12 are in the thickness of the tab 4, and are close to each other. Because the tab 4 is slender, stress of the material is distributed over a limited cross sectional dimension of the tab 4. The tab 4 includes a relatively wide section 13 adjacent to the intersection of the tab 4 with a bottom edge 14 of a slot 15 that separates the tab 4 from an edge surface 16 that extends transversely of the axis 5 of the electrical contact portion 3. The slot 15 extends axially of the contact 1 and has a rear, open end 17. The front, bottom edge 14 of the slot 15 has rounded inside corners to alleviate concentration of stress. A first bend 11 in the tab 4 extends across the relatively wide section 13 and intersects the slot 15. The first bend 11 in the tab 4 intersects the slot 15 and prevents stress concentration 14 at the intersection of the tab 4 and the rounded bottom edge 14 of the slot 15.

A second bend 12 in the tab 4 extends across a relatively narrow section 18 of the tab 4 and intersects the slot 15. The second bend 12 extends parallel to and is adjacent to the first bend 11. The second bend 12 is in a direction opposite to the direction of the first bend 11. The narrow section 18 has a width selected to approximate the width of a wire, not shown, to be joined to the tab 4 by, for example, a weld joint, or solder joint.

A shoulder 19 is transverse to the length of the contact 1 and is between the first bend 11 and the second bend 12. The shoulder 19 is on the offset portion 10 at the intersection of the wide portion 13 and the narrow portion 18. A rounded inside corner is provided at the intersection of 13 and 18 to alleviate stress concentration. Concentration of stress by bending is avoided by the bends 11 and 12 avoiding the intersection.

The edge surface 16 is beside the tab 4 and extends transversely across the longitudinal axis 5 of the contact portion 3. The edge surface 16 is used for a bearing surface against which a tool, not shown, is urged, to drive the contact 1 into a corresponding cavity 20, FIGS. 4 and 5, of an insulative housing 21.

Figure 4:
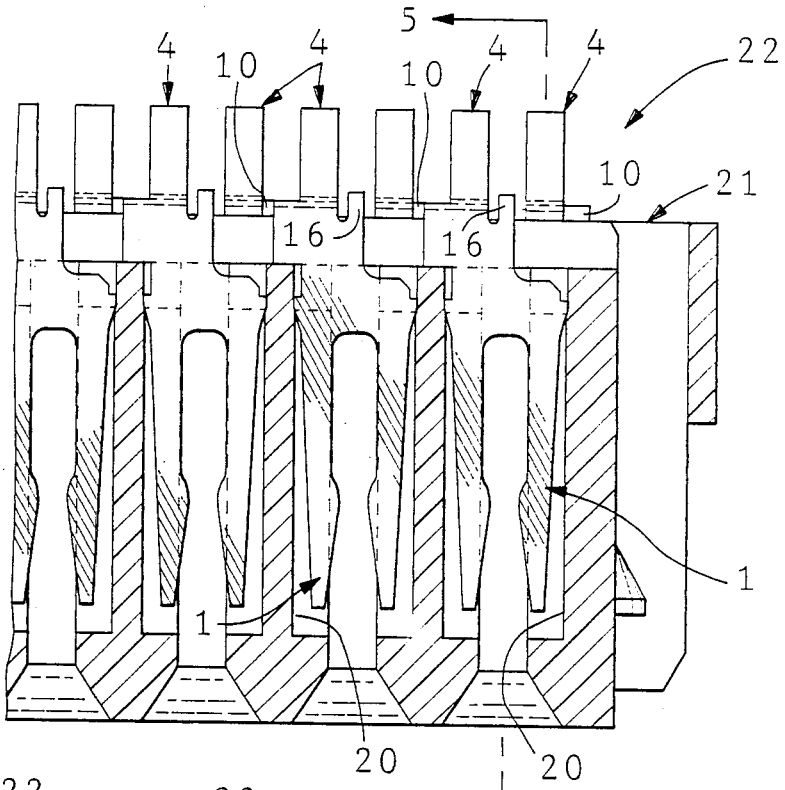
FIG. 4 is a fragmentary elevation view in section of a connector assembly.
Figure 5:
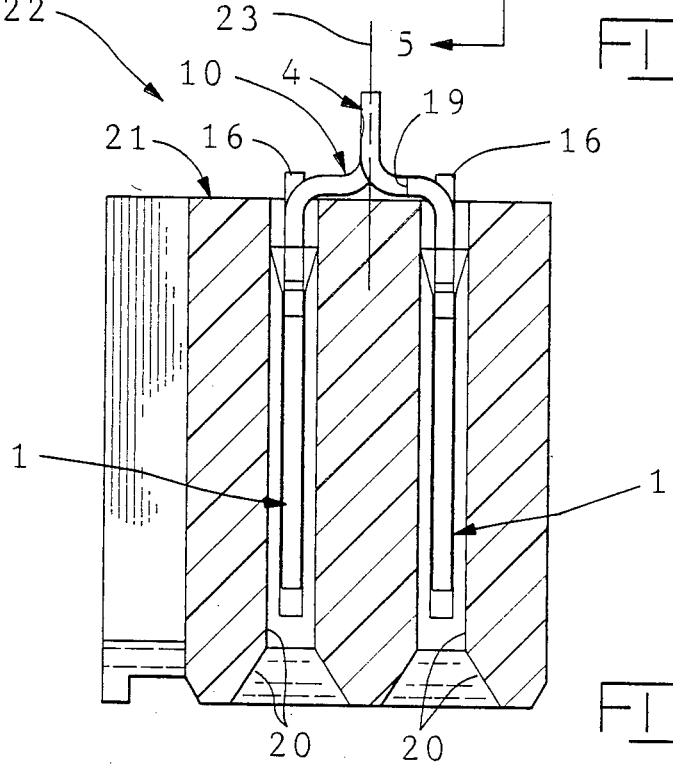
FIG. 5 is a section view taken along the line 5—5 of FIG. 4.

An electrical connector assembly 22, FIGS. 4 and 5, includes the insulative housing 21 and two rows of spaced apart cavities 20 in the housing 21. Each cavity 20 receives a corresponding contact 1 such that the contacts 1 are in two rows. The electrical contacts 1 of the same first row have their corresponding tabs 4 offset at 10 to lie in a common plane 23. The electrical contacts 1 of the second row have their corresponding tabs 4 offset to lie in the same common plane 23, with the tabs 4 of the first row alternating with the tabs 4 of the second row. Having the tabs 4 available in a common plane 23 facilitates a procedure of joining the tabs 4 to corresponding wires, not shown. According to a known procedure, the wires are simultaneously overlaid upon the coplanar tabs 4 and are connected in one joining operation, for example, by soldering or welding.

I claim:

1. An electrical contact comprises; an elongated electrical contact portion, a wire connecting tab offset from a longitudinal center axis of the contact portion, an offset portion of the contact connects the tab to a central portion of the contact, and the improvement comprises; a first bend extending across a relatively wide section of the tab, a second bend extending across a relatively narrow section of the tab and parallel to to the first bend, a slot extending beside the tab, the first bend in the tab intersects the slot, and the relatively wide section prevents concentration of stress from the first bend at the intersection of the tab and a bottom edge of the slot.

2. An electrical contact as recited in claim 1, the improvement further comprising; the second bend is in a direction opposite to the direction of the first bend.

3. An electrical contact as recited in claim 1, the improvement further comprising; a shoulder on the relatively wider section of the tab is on the offset portion between the first and second bends.

4. An electrical contact as recited in claim 1, the improvement further comprising; the first bend extends along a line transverse to the length of the tab.

5. An electrical contact as recited in claim 1, the improvement further comprising; the second bend extends along a line transverse to the length of the tab.

6. An electrical contact as recited in claim 1, the improvement further comprising; rounded inside corners on the bottom edge.

7. An electrical contact as recited in claim 1, the improvement further comprising; a rounded inside corner at an intersection of the relatively wide section and the relatively narrow section.

* * * * *